US006076209A

United States Patent [19]

Paul

[11] Patent Number: 6,076,209

[45] **Date of Patent: *Jun. 20, 2000**

[54] ARTICULATION MECHANISM FOR A MEDICAL BED

[76] Inventor: Gerald S. Paul, 201 E. Westcott, Liberty, Ind. 47353

[21] Appl. No.: 09/185,553

[22] Filed: Nov. 3, 1998

Related U.S. Application Data

[63] Continuation-in-part of application No. 08/774,150, Dec. 26, 1996.

[51] Int. Cl.[7] ..... A61G 7/04

[52] U.S. Cl. ..... 5/617; 5/613; 5/616; 5/942; 5/600

[58] Field of Search ..... 5/617, 616, 613, 5/942, 600, 153, 155, 149, 202, 249, 250, 252

[56] References Cited

U.S. PATENT DOCUMENTS

| | | | |
|---|---|---|---|
| 3,220,024 | 11/1965 | Nelson | 5/331 |
| 3,317,931 | 5/1967 | Benoit et al. | 5/68 |
| 3,329,423 | 7/1967 | Kleinman | 269/324 |
| 3,414,913 | 12/1968 | Stanley et al. | 5/68 |
| 3,602,929 | 9/1971 | Murcott et al. | 5/331 |
| 3,608,102 | 9/1971 | Goodman | 5/63 |
| 3,747,133 | 7/1973 | Hutt | 5/331 |
| 3,821,821 | 7/1974 | Burst et al. | 5/68 |
| 3,821,952 | 7/1974 | Binegar | 128/70 |
| 3,823,428 | 7/1974 | Whyte | 5/331 |
| 3,840,911 | 10/1974 | Benoit et al. | 5/68 |
| 4,025,972 | 5/1977 | Adams et al. | 5/68 |
| 4,038,709 | 8/1977 | Kerwit | 5/68 |
| 4,064,575 | 12/1977 | Sanders | 5/331 |
| 4,095,296 | 6/1978 | Ferro | 5/69 |
| 4,227,269 | 10/1980 | Johnston | 5/66 |
| 4,344,422 | 8/1982 | Immel | 5/69 |
| 4,361,917 | 12/1982 | Wilson | 5/68 |
| 4,376,316 | 3/1983 | Mercier et al. | 5/66 |
| 4,376,317 | 3/1983 | Johnston | 5/80 |
| 4,395,786 | 8/1983 | Casey et al. | 5/66 |
| 4,439,880 | 4/1984 | Koncelik et al. | 5/429 |
| 4,494,259 | 1/1985 | Miller et al. | 5/66 |
| 4,535,492 | 8/1985 | Sebest | 5/68 |
| 4,628,553 | 12/1986 | Buttitta et al. | 5/62 |
| 4,724,559 | 2/1988 | Bly et al. | 5/425 |
| 5,084,925 | 2/1992 | Cook | 5/425 |
| 5,105,486 | 4/1992 | Peterson | 5/611 |
| 5,404,604 | 4/1995 | Has et al. | 5/617 |
| 5,469,591 | 11/1995 | Nomura | 5/617 X |

*Primary Examiner*—Terry Lee Melius
*Assistant Examiner*—Fredrick Conley
*Attorney, Agent, or Firm*—Biebel & French

[57] ABSTRACT

An articulated medical bed for supporting a person in articulated movement is disclosed. The bed comprises a main frame defining a base and an articulated support frame including an upper body section pivotally connected to the base, a seat section pivotally connected to the upper body section and a detachably mounted lower leg section pivotally connected to the seat section. An elongated link member pivotally connects the lower leg section to the base. A glide member is mounted on the seat section and supported for linear movement along the base whereby the seat section is supported for rocking movement about the glide member. A linear actuator is connected to the upper body section for simultaneously actuating the upper body section, seat section and lower leg section in articulated movement. A side rail is supported on the base and includes telescoping inner and outer horizontal rail members extending between vertical rail members. A detent supported on one of the inner horizontal rail members is engagable with a plurality of recesses formed in one of the outer horizontal rail members. Engagement of the detent with one of the recesses locks the inner horizontal rail member relative to the outer horizontal rail member thereby defining a plurality of positive stop positions. The linear actuator is controlled by a control stick supported on the side rail and located within a plane defined by the horizontal and vertical rail members.

14 Claims, 10 Drawing Sheets

ARTICULATION MECHANISM FOR A MEDICAL BED

CROSS REFERENCE TO RELATED APPLICATIONS

This application is a Continuation-In-Part of U.S. patent application Ser. No. 08/774,150, filed Dec. 26, 1996.

BACKGROUND OF THE INVENTION

1. Field of the Invention

The present invention relates to adjustable beds and, more particularly, to articulated medical beds for use in the long term care and home care markets.

2. Description of the Prior Art

Bedridden individuals often develop blood circulation problems and commonly experience general discomfort from lying in a single planar position over extended periods of time. To facilitate the occupant's care and comfort, medical beds are often designed to include distinct articulated support sections which are adjustable between a plurality of positions. The articulated sections typically provide for occupant positions ranging from a horizontal lying position to a contoured sitting position.

While articulated beds have found wide spread use in hospitals, nursing homes, long term care facilities and home care markets, such beds are usually expensive devices employing complicated adjustment mechanisms. An example of such an adjustable bed is disclosed in U.S. Pat. No. 4,395,786 to Casey et al. The bed in Casey et al. includes a complex linkage arrangement driven by two separate actuators for adjusting three articulated support sections. One actuator moves an articulated head section while a second actuator adjusts articulated foot and thigh sections. Accordingly, there is a need for an articulated medical bed of a simple design including multiple articulated support sections which are adjustable by a single actuator.

Another problem often associated with articulated medical beds is the length of the sleeping surface. Hospitals, nursing homes and long term care facilities typically cannot predict the height of their incoming patients or residents. These facilities often waste limited resources by purchasing a variety of beds having different sleeping surface lengths. Accordingly, there is a need for an articulated bed which may be easily and inexpensively altered to adapt its sleeping surface length to the height of its occupant.

It is well known in the art to use a safety side rail in conjunction with articulated medical beds. Such side rails are typically located adjacent to the sleeping surface and prevent the occupant from falling out of the bed. As disclosed in U.S. Pat. No. 3,823,428 to Whyte and U.S. Pat. No. 4,439,880 to Koncelik et al., side rails are often adjustable in a horizontal direction. However, the prior art side rails have limited adjustability in that they have positive stops only in a fully retracted or fully extended state. The occupant is often inadequately protected when the side rail is fully retracted in that a large opening exists through which the patient could fall. Conversely, the occupant is often unnecessarily confined when the side rail is fully extended. Accordingly, there is a need for an articulated medical bed including a adjustable side rail having intermediate positive stops between fully retracted and fully extended positions.

Articulated medical beds are typically adjusted by the occupant utilizing a controller for causing articulated movement of the support sections. The controller usually comprises either a hand-held push button or a push button embedded in one of the side rails of the bed. Patients will often lack the hand-eye coordination, finger dexterity or mental alertness required to operate the prior art controllers. Accordingly, there is a need for an articulated medical bed having a controller which facilitates operation by disoriented occupants or those lacking good coordination skills or finger dexterity.

SUMMARY OF THE INVENTION

The present invention provides an articulated medical bed of a simple structure including an articulated, variable length support frame which is adjustable by a single actuator activated by a control stick mounted to a telescoping side rail having intermediate positive stop positions.

In accordance with the present invention, an articulated medical bed is disclosed which includes an articulated support frame mounted to a base defined by a main frame. The support frame includes an upper body section, a pocket section, a seat section and a lower leg section. A pivot connection connects the upper body section to the main frame for pivotal movement of the upper body section relative to the base. A first end of the seat section is pivotally connected to a second end of the upper body section while a second end of the seat section is pivotally connected to a first end of the lower leg section. The pocket section is connected to the upper body section and the seat section and is supported for sliding movement relative to at least one of the upper body section and the seat section.

Elongated link members have first ends pivotally connected to the main frame and second ends pivotally connected to a second end of the lower leg section. The lower leg section and the elongated link members are detachably mounted whereby the lower leg section is replaceable with another lower leg section having a different length. A glide member is mounted on the seat section and supported for linear movement along the base. The seat section is supported for rocking movement about the glide member in response to pivotal movement of the upper body section about the pivot connection. A linear actuator is connected to the upper body section for actuating the upper body section in pivotal movement. Upon pivotal movement of the upper body section the seat section and lower leg section are simultaneously actuated for articulated movement.

A side rail is supported on the main frame and located adjacent to the support frame. The side rail includes vertical rail members extending above the support frame and horizontal rail members extending between the vertical rail members. The horizontal rail members comprise inner horizontal rail members received within outer horizontal rail members in a telescoping relationship whereby the inner horizontal rail members are mounted for movement relative to the outer horizontal rail members. One of the inner horizontal rail members defines a fully retracted position of the inner horizontal rail member relative to the outer horizontal rail member. A plurality of recesses are formed in one of the outer horizontal rail members for receiving a detent supported on one of the inner horizontal rail members. Engagement of the detent with one of the recessed portions locks the inner horizontal member relative to the outer horizontal member in either a fully extended position or a predetermined intermediate position between the fully retracted and fully extended positions.

Operation of the linear actuator is controlled by movement of a control stick supported on at least one of the vertical and horizontal rail members of the side rail. The control stick is preferably located within a side rail plane defined by the vertical and horizontal rails. Movement of the control stick in a first direction actuates the actuator for moving the upper body section upwardly while movement of the control stick in a second direction actuates the actuator for moving the upper body section downwardly. As the upper body section moves upwardly, the pivot connection between the upper body section and the seat section moves downwardly, while the pivot connection between the seat section and the lower leg section moves upwardly. As the upper body section moves downwardly, the seat section and lower leg section articulate in a reverse direction. The pivot connection between the seat section and the lower leg section is never lower than the pivot connection between the upper body section and the seat section such that the occupant's feet are never lower than his hips thereby facilitating improved blood circulation.

Therefore, it is an object of the present invention to provide an articulated medical bed of simple design including a support frame having multiple articulated support sections which are simultaneously adjustable by a single actuator.

It is a further object of the invention to provide such an articulated medical bed wherein the support frame has an adjustable length.

It is yet another object of the invention to provide such an articulated medical bed including an adjustable side rail having intermediate positive stop positions between fully retracted and fully extended positions.

Still another object of the invention is to provide such an articulated medical bed having a control stick which facilities activation of the actuator by a disoriented occupant or one lacking good coordination skills or finger dexterity.

Other objects and advantages of the invention will be apparent from the following description, the accompanying drawings and the appended claims.

DETAILED DESCRIPTION OF THE PREFERRED EMBODIMENT

Figure 1:
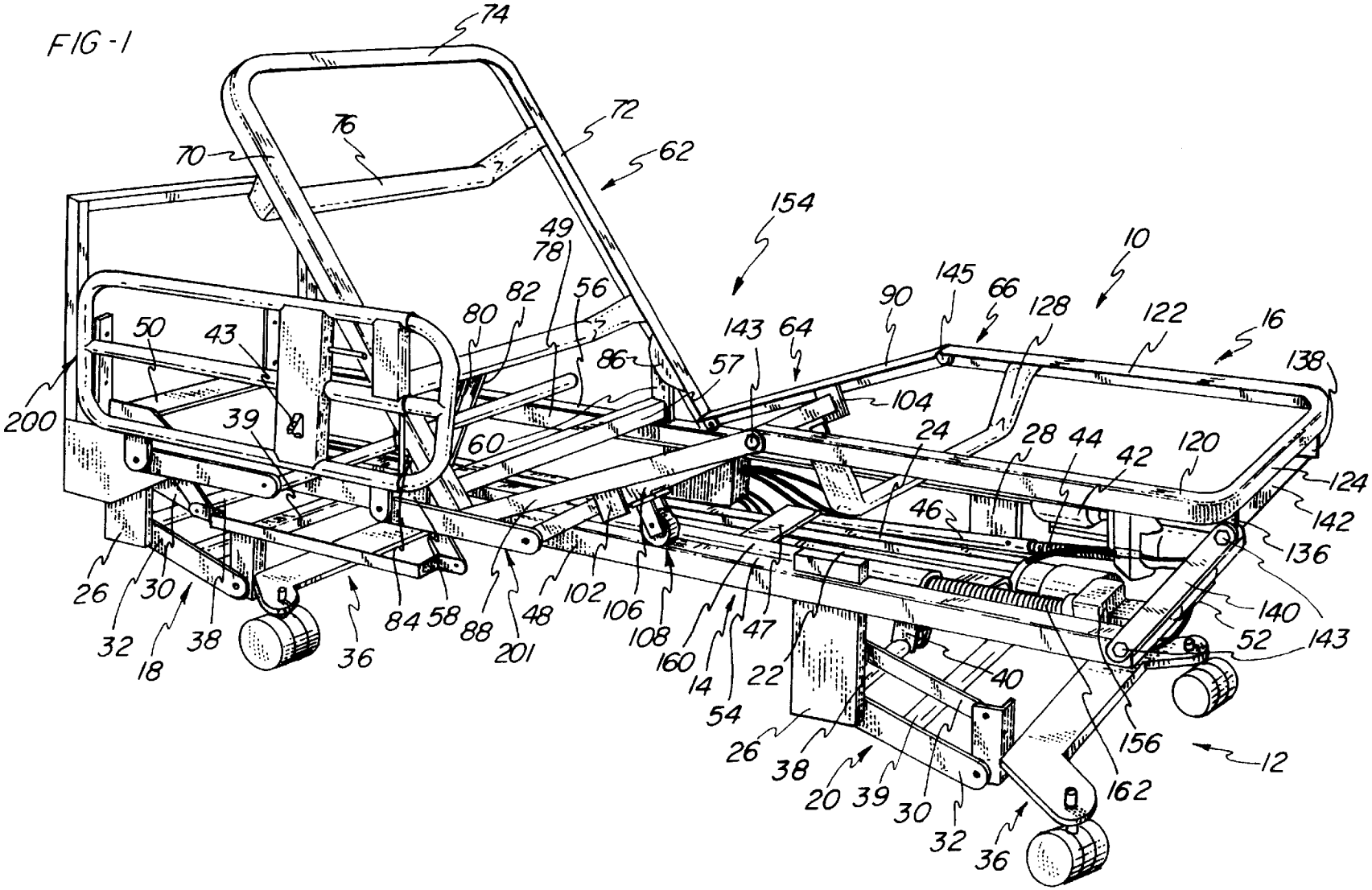
FIG. 1 is a perspective view of the articulated medical bed of the present invention.
Figure 2:
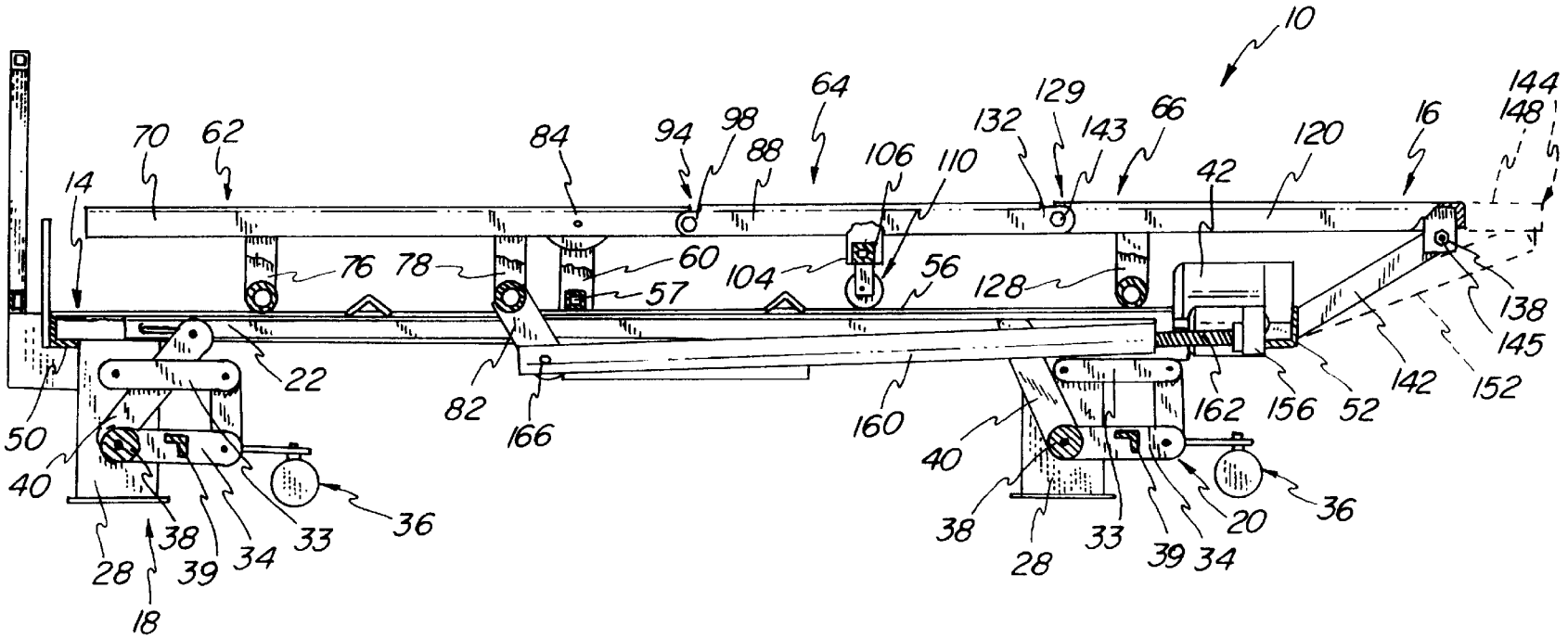
FIG. 2 is a side view with a partial cut-away of the articulated medical bed of the invention, showing the support frame in a planar position.
Figure 4:
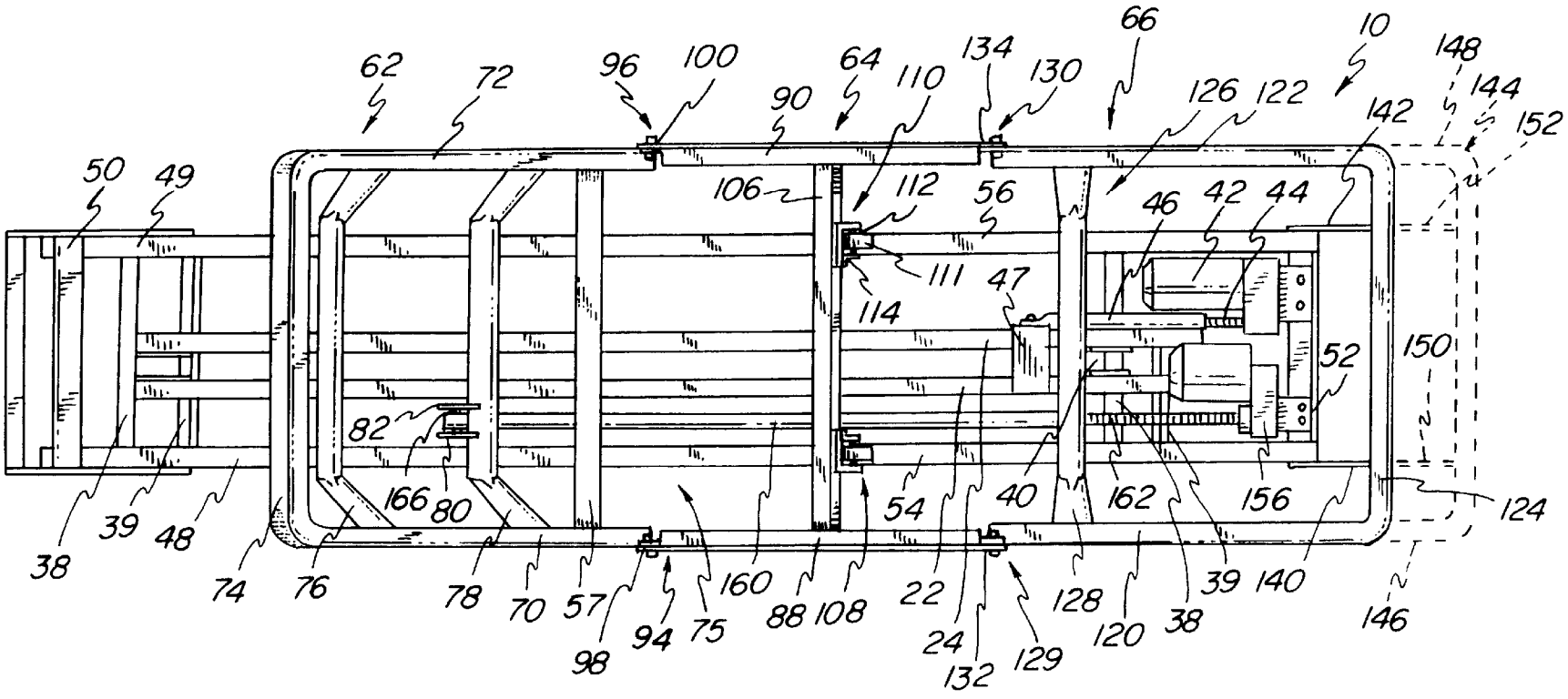
FIG. 4 is a top plan view of the articulated medical bed of FIG. 3.

Referring initially to FIGS. 1 and 2, the present invention comprises an articulated medical bed 10 including an adjustable bottom structure 12 supporting a main frame 14 and an articulated support frame 16. The adjustable bottom structure 12 is of a type well known in the art and includes two identical linkage assemblies 18, 20 which are operably connected by parallel connecting angle irons 22, 24 (FIGS. 1 and 4).

Each linkage assembly 18, 20 includes brackets 26, 28 mounted to the main frame 14. A first pair of parallel link members 30, 32 have first ends pivotally mounted to bracket 26 and second ends pivotally mounted to a wheel assembly 36. A second pair of parallel link members 33, 34 (FIG. 2) are connected to parallel link members 30, 32, by transverse rods 38, 39 and wheel assembly 36. Each transverse rod 38 is pivotally connected to angle irons 22, 24 by a bracket structure 40. A motor 42, in response to a control switch 43, selectively rotates a drive screw 44 which is threadably received within a first end of a drive rod 46. A second end of the drive rod 46 is welded to a bracket 47 which joins the angle irons 22 and 24, wherein rotation of the drive screw 44 causes linear movement of the angle irons 22 and 24 (FIGS. 1 and 4). As the angle irons 22 and 24 move, each bracket structure 40 causes the respective transverse rod 38 to rotate wherein the link members 30, 32 and 34, 36 of each linkage assembly 18, 20 pivot. The main frame 14 and articulated support frame 16 are thereby forced to move vertically relative to the wheel assemblies 36 wherein the height of the bed 10 is adjusted.

Referring to FIGS. 1 to 4, the main frame 14 includes side angle irons 48, 49 welded or otherwise securely fixed to end angle irons 50, 52 to define a generally rectangular base. The upper surface of side angle irons 48, 49 define upwardly facing elongated support portions 54, 56, respectively. Fixedly secured to the side angle irons 48, 49 is a transverse support member 57 having brackets 58 and 60 welded thereto which project upwardly.

Supported above the main frame 14 is the articulated support frame 16 comprising articulated upper body, seat, pocket and lower leg sections 62, 64, 65 and 66, respectively, (FIGS. 1 and 5) which are adapted for supporting a person in articulated movement. The upper body section 62 is formed of a U-shaped angle iron having upper longitudinal members 70, 72, an upper end member 74 and an open end 75. Cross members 76, 78 are welded transversely to upper longitudinal members 70 and 72 and thereby impart structural rigidity to the upper body section 62 wherein a pair of hinges 80, 82 are welded to cross member 78. The upper longitudinal members 70 and 72 form pivot connections 84 and 86 with the brackets 58 and 60 of the main frame 14 wherein the upper body section 62 is adapted for pivotal movement relative to the main frame 14. The pivot connections 84 and 86 are located intermediate the cross member 78 and the open end 75 of the upper body section 62.

The seat section 64 comprises a pair of seat longitudinal members 88, 90 formed of angle iron and each pivotally connected at a first end to upper longitudinal members 70, 72 thereby forming upper articulable connections 94, 96, respectively. The upper articulable connections 94, 96 are formed by flange members 98, 100 which extend longitudinally from the seat longitudinal members 88, 90 and pivotally connect to the upper longitudinal members 70, 72, respectively (FIG. 4). A pair of brackets 102, 104 are welded to and extend downwardly from the seat longitudinal members 88, 90. A pivot bar 106 is securedly fixed transversely between the brackets 102, 104. A pair of glide members 108, 110 are mounted to the pivot bar 106 for engaging respective support portions 54, 56 of the main frame 14. Each glide member 108, 110 preferably comprises a roller 111 mounted to an axle 112 which is rotatably received within a bracket structure 114 (FIG. 4). The bracket 114 is welded to the lower surface of the pivot bar 106.

The lower leg section 66 comprises a U-shaped angle iron having lower longitudinal members 120, 122, a lower end member 124 and an open end 126. A cross member 128 is welded to the lower longitudinal members 120, 122 transversely to the lower leg section 66 for improved structural rigidity. The lower longitudinal members 120, 122 pivotally connect with the seat longitudinal members 88, 90 to define lower articulable connections 129, 130. The lower articulable connections 129, 130 are formed by flange members 132, 134 longitudinally extending from the seat longitudinal members 88, 90 and pivotally mounted to the lower longitudinal members 120, 122 adjacent the open end 126 (FIG. 4).

A pair of brackets 136, 138 are welded to the lower end member 124 and project downwardly. Elongated link members 140, 142 have one end pivotally connected to the brackets 136, 138 and a second end pivotally mounted to the side angle irons 48, 49 adjacent the end angle iron 52. The elongated link members 140, 142 are dimensioned such that the lower leg section 66 is always maintained substantially parallel to the main frame 14.

The lower leg section 66 is detachably mounted to the seat section 64 and to the elongated link members 140, 142. More specifically, the lower articulable connections 129, 130 and connections to the elongated link members 140, 142 include bolts 143 threadably engaging nuts 145 which are easily removed in a manner as is well known in the art. The lower leg section 66 may therefore be removed and replaced with a lower leg section 144 having lower longitudinal members 146, 148 of a different length than the length of members 120, 122. When altering the length of the lower leg section 66, the elongated link members 140, 142 must likewise be replaced with elongated link members 150, 152 of varied length for ensuring that the lower leg section 66, 144 is always maintained in substantially parallel alignment with the main frame 14.

Figure 3:
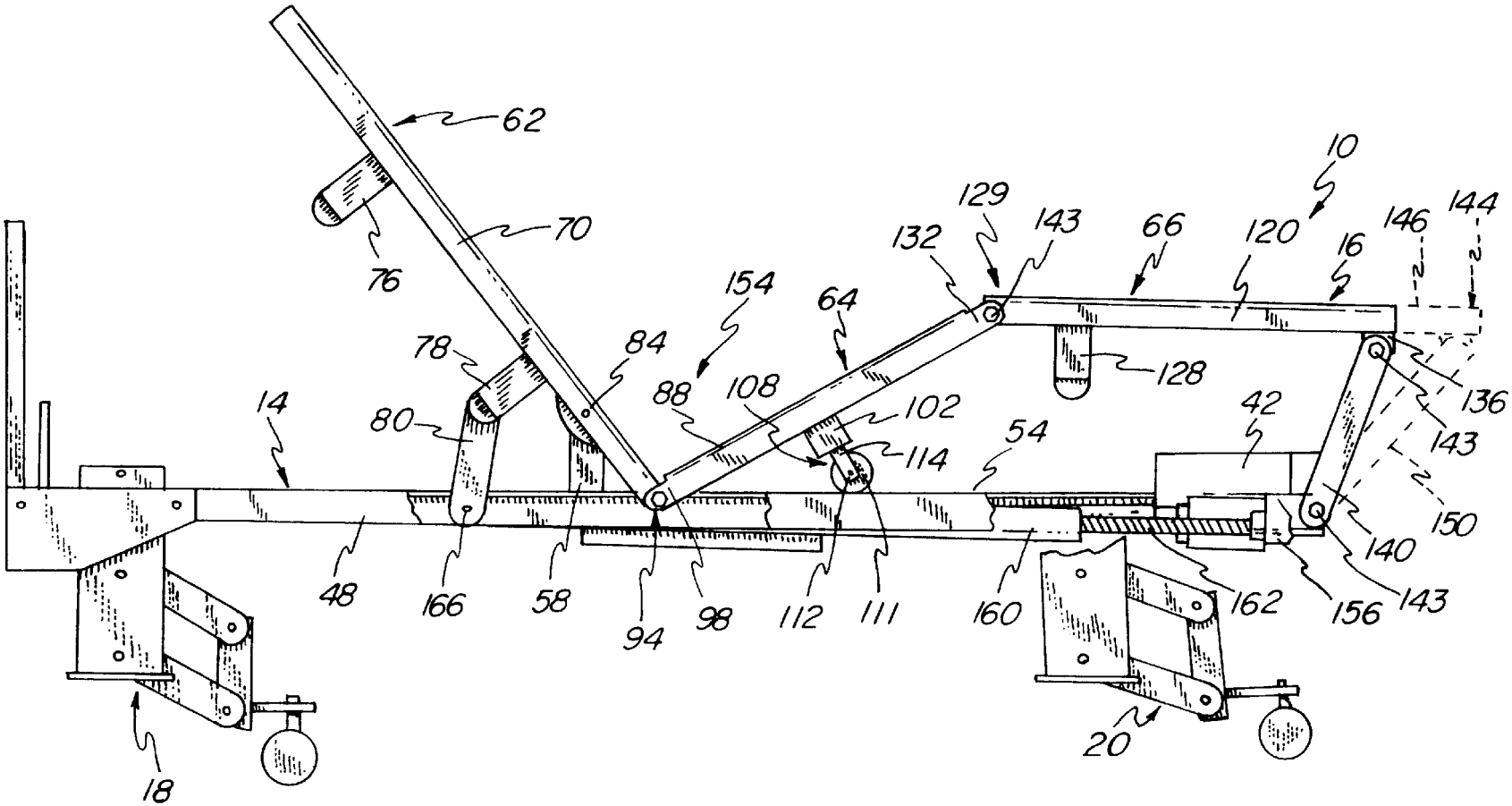
FIG. 3 is a side view with a partial cut-away of the articulated medical bed of FIG. 2, showing the support frame in a contoured position.

The unique articulation of the support frame 16 allows the upper body, seat and lower leg sections 62, 64 and 66 to be moved from a planar configuration as shown in FIG. 2 to a contoured recliner-like position as shown in FIG. 3. As the upper body section 62 is tilted upwardly with respect to the base 54, the upper body section 62 and seat section 64 articulate towards each other, thereby defining a V-shaped "pocket" portion 154 for receiving the buttocks and lower back portion of an occupant of the bed 10. The dimensioning of the upper body section 62, seat section 64, lower leg section 66 and elongated link members 140, 142, in combination with the positioning of the pivot connections 84, 86 and glide members 108, 110 ensure that the upper articulable connections 94, 96 are never above the lower articulable connections 129, 130 wherein the occupant's hips are never above his feet. Further, the unique articulation structure of the support frame 16 maintains the lower leg section 66 in substantially parallel alignment with the main frame 14 regardless of the position of the upper body section 62 and seat section 64.

Figure 5:
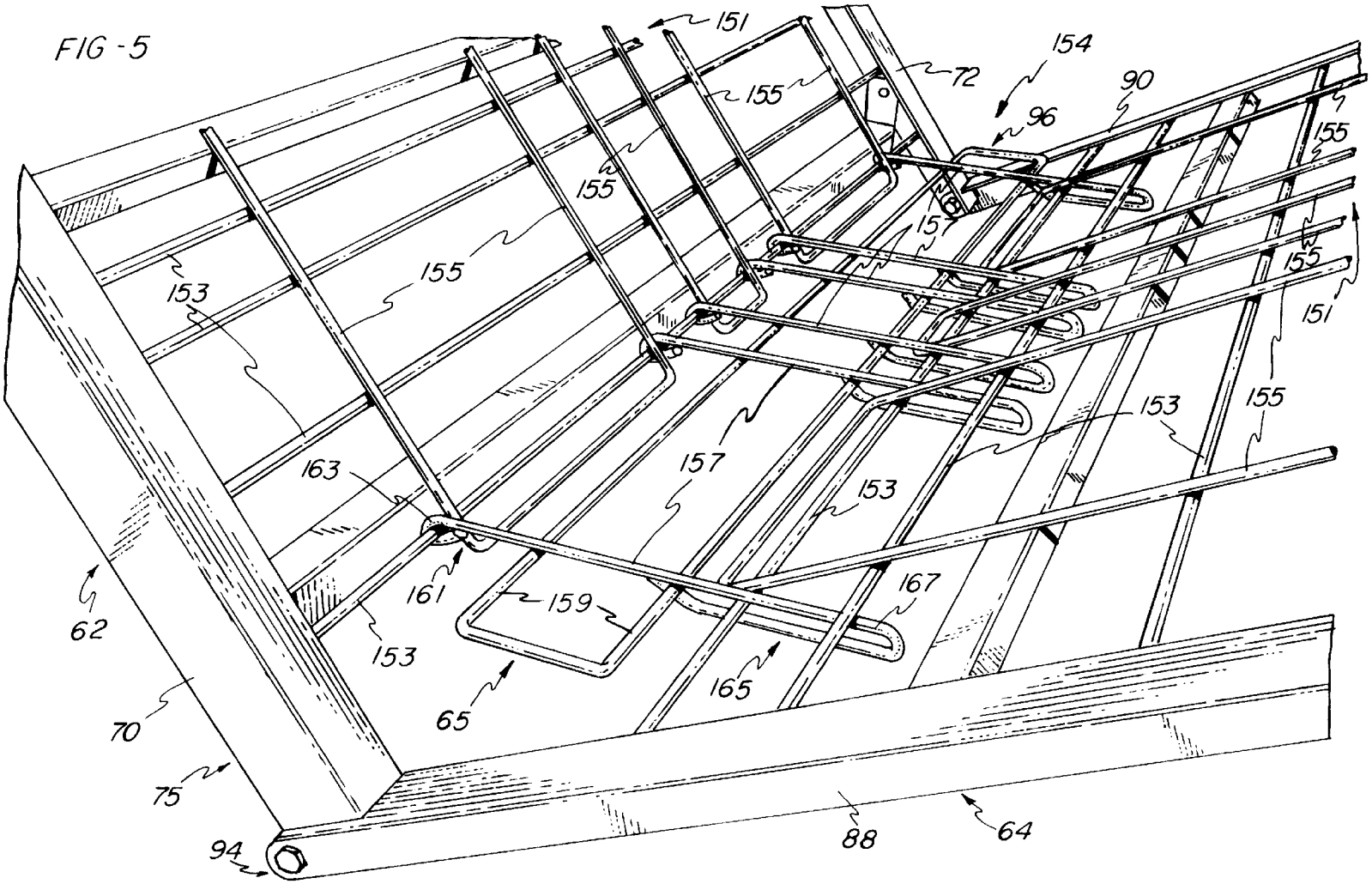
FIG. 5 is a perspective view of the pocket section of the present invention.
Figure 6:
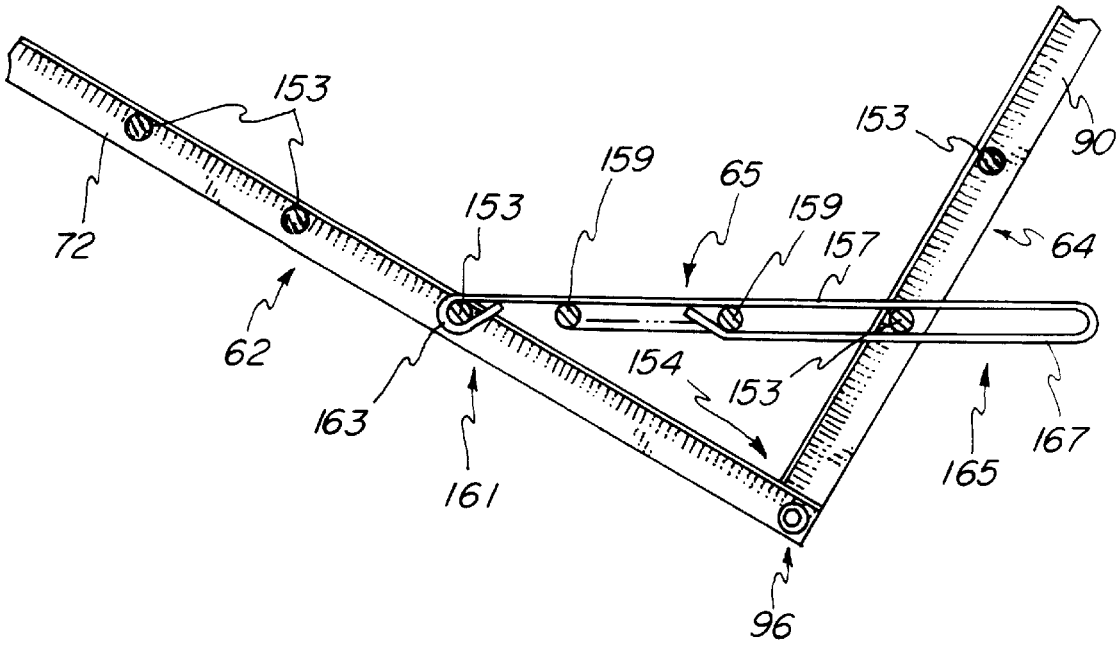
FIG. 6 is a cross sectional view of the pocket section of FIG. 5 in partial schematic with the upper body section in a raised position.
Figure 7:
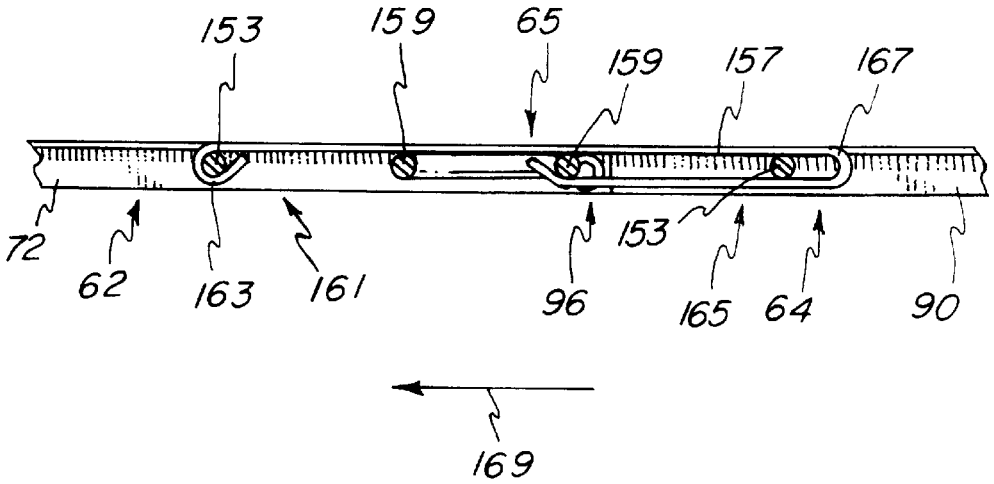
FIG. 7 is a cross sectional view of the pocket section of FIG. 5 in partial schematic with the upper body section in a lowered position.

Turning now to FIGS. 5–7, mattress supporting structures 151 are supported by both the upper body section 62 and seat section 64. While not shown, the lower leg section 66 likewise supports a mattress supporting structure of the type well known in the art and similar to the structures 151 of the upper body and seat sections 62 and 64. For clarity, the mattress supporting structures 151 are omitted from the drawings except for FIGS. 5-7.

Each mattress supporting structure 151 includes a plurality of laterally extending mattress supports 153 fixed to either the upper longitudinal members 70 and 72 of the upper body section 62, to the seat longitudinal members 88 and 90 of the seat section 64, or to the lower longitudinal members 120 and 122 of the lower leg section 66. Preferably, a plurality of longitudinally extending mattress supports 155 are fixed perpendicularly relative to the mattress supports 153 thereby providing added structural rigidity to each mattress supporting structure 151.

As noted above, a V-shaped pocket 154 is defined between the upper body section 62 and seat section 64 as they articulate towards each other. Often, the pocket 154 may form a sharp and deep recess for receiving a mattress (not shown). The pocket section 65 is preferably disposed between the upper body section 62 and the seat section 64 in order to soften or reduce the sharp angle within the pocket 154, thereby facilitating a comfortable contour on the surface of the mattress for the occupant of the bed 10.

The pocket section 65 comprises a plurality of longitudinally extending pocket supports 157 fixed to a plurality of laterally extending pocket supports 159. Together, the pocket supports 157 and 159 define a rigid structure for supporting a mattress.

Each pocket support 157 extends longitudinally between a laterally extending mattress support 153 of the upper body section 62 and a laterally extending mattress support 153 of the seat section 64. More particularly, a first end 161 of each pocket support 157 is formed in a loop 163 received around the mattress support 153 closest to the open end 75 of the upper body section 62 such that the pocket support 157 may pivot about the mattress support 153. A second end 165 of each pocket support 157 is formed with an elongated loop 167 which slidably receives the mattress support 153 of the seat section 64 in proximity to the upper articulable connections 94 and 96. As may be readily appreciated, the pocket section 65 is supported for sliding movement above the upper articulable connections 94 and 96.

FIG. 6 illustrates the pocket section 65 when the upper body section 62 and the seat section 64 have been articulated toward each other and placed in a raised position to thereby define the pocket 154. Turning to FIG. 7, as the support frame 16 is returned to a substantially planar position by returning the upper body section 62 and the seat section 64 to a lowered position, the pocket section 65 is pulled by the upper body section 62 away from the seat section 64 as indicated by arrow 169. As the pocket section 65 is pulled by the upper body section 62, the mattress support 153 of the seat section 64 in proximity to the upper articulable connections 94 and 96 slides within the elongated loops 167 of the plurality of pocket supports 157. When the upper body section 62 and the seat section 64 are fully lowered, the pocket portion 65 is in substantially planar alignment therewith.

Movement of the upper body section 62 about the pivot connections 84, 86 is provided by an actuator, preferably a standard electric motor 156. A first end of a drive rod 160 threadably receives a drive screw 162 which is rotated by the motor 156 in a conventional manner. The second end of the drive rod 160 is pivotally mounted to cross member 78 of the upper body section 62 by a shaft 166 passing through the drive rod 160 and the hinges 80, 82 (FIG. 4).

In operation, as the motor 156 rotates the drive screw 162, the drive rod 160 linearly moves thereby pushing against the shaft 166 and hinges 80, 82. In response, the upper body section 62 rotates upwardly about the pivot connections 84, 86. The seat section 64 moves linearly towards the upper body portion 62 as the glide members 108, 110 move along the support portions 54, 56. The glide members 108, 110 further facilitate rocking movement of the seat section 64 in response to movement of the upper body portion 62. As the seat section 64 moves, the lower leg section 66 moves upwardly away from the main frame 14 and towards the upper body section 62 while always remaining substantially parallel to the main frame 14.

Turning again to FIG. 1, in the preferred embodiment of the invention, a side rail 200 is mounted to the main frame 14 through a vertically adjustable parallelogram linkage 201 assembly of the type well known in the art. Since details of the linkage assembly 201 form no part of the invention, they will not be further discussed herein.

Referring now to FIGS. 5–7 and 14, the side rail 200 includes a first portion 202 and a second portion 204 wherein the second portion 204 is adapted for linear movement relative to the first portion 202. The first portion 202 includes top, middle and bottom outer horizontal rail members 206, 208, 210 formed of hollow tubular steel having an internal passageway. A U-shaped steel tube defines the top and bottom outer horizontal rail members 206 and 210 and the interconnecting vertical rail member 212. Vertical rail member 212 includes an internal passageway communicating with the internal passageway of the horizontal rail member 208 which is welded centrally between rail members 206 and 210. Vertical rail members 214 and 215 (FIGS. 5 and 14) are formed of steel rod and are welded between outer horizontal rail members 206 and 208, and 208 and 210, respectively.

The second portion 204 of the side rail 200 includes top, middle and bottom inner horizontal rail members 216, 218, 220 received within respective outer horizontal rail members 206, 208, 210 in a telescoping relationship as is well known in the art. A single piece of hollow tubular steel formed into a U-shape defines top and inner bottom horizontal rail members 216 and 220 and an interconnecting vertical rail member 222. Middle inner horizontal rail member 218 is formed of hollow tubular steel and welded to vertical rail member 222 centrally between rail members 216 and 220. As illustrated in FIG. 7, the middle inner rail member 218 is longer than the top and bottom inner rail members 216, 220. As represented by reference letter "A" in FIG. 5, rail member 218 defines a fully retracted position of the second portion 204 relative to the first portion 202 wherein an end 224 of the rail member 218 (FIG. 7) contacts an inner surface of the vertical rail member 212.

Figure 8:
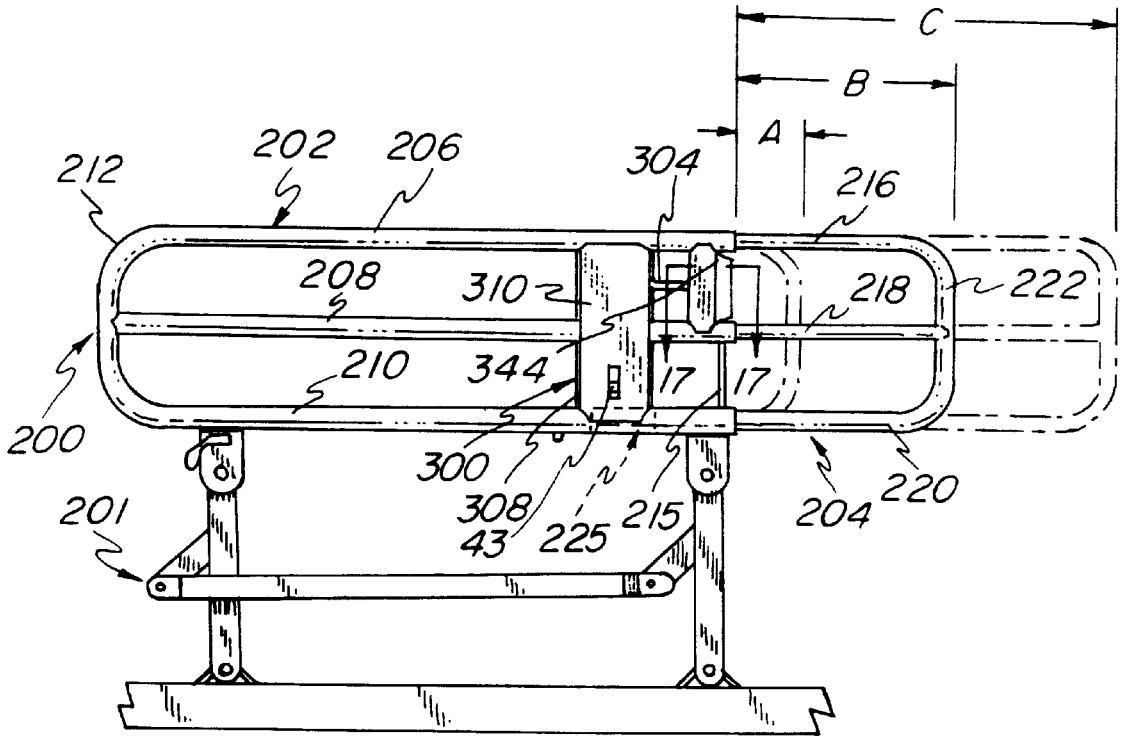
FIG. 8 is a side view of the side rail of the invention.
Figure 9:
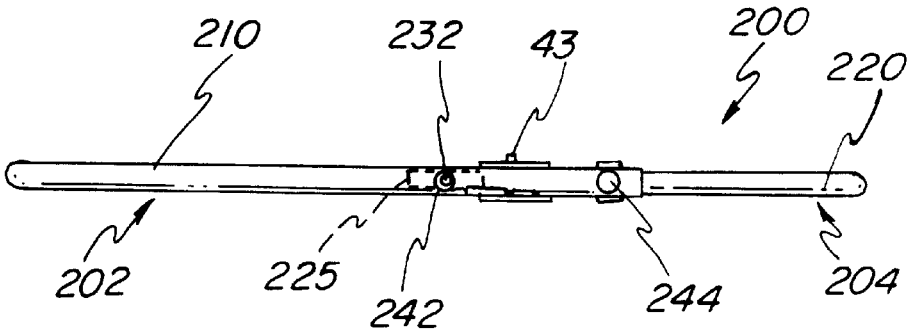
FIG. 9 is a bottom view of the side rail of FIG. 8.
Figure 10:
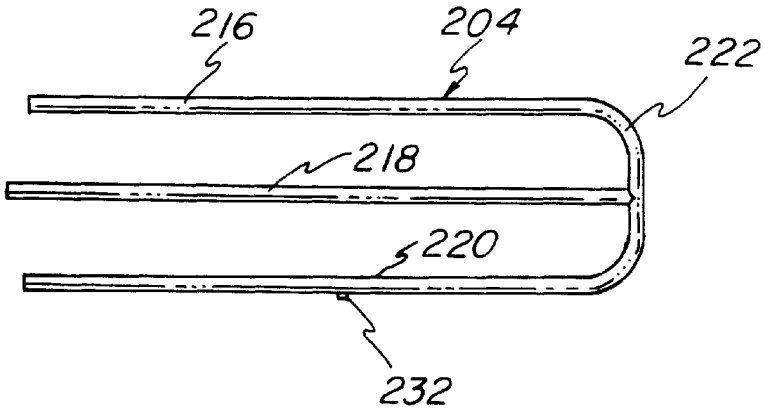
FIG. 10 is a side view of the second portion of the side rail of FIG. 8.
Figure 17:
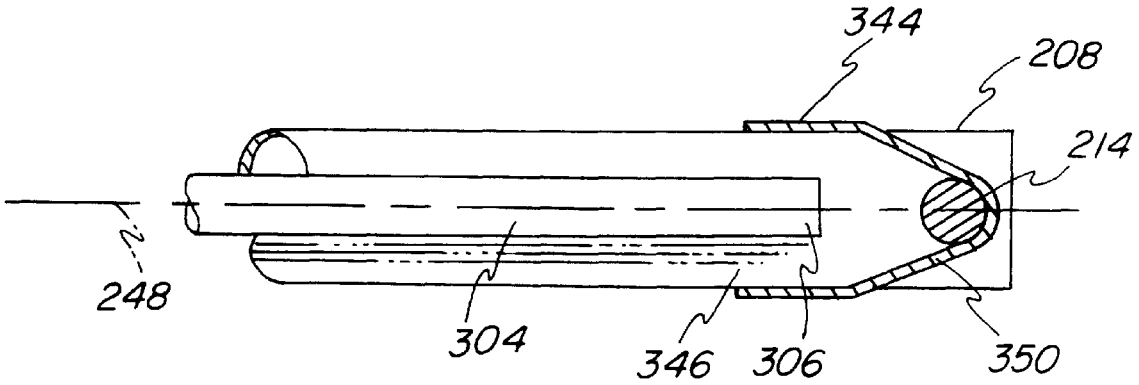
FIG. 17 is a partial cross sectional view of the guide member of the invention taken along line 17—17 in FIG. 8.

The side rail 200 includes a locking means or lock structure 225 for defining a fully extended position, represented by reference letter "C" in FIG. 4. The lock structure 225 further defines at least one intermediate positive stop position of the second portion 204 relative to the first portion 202 as represented by reference letter "B" in FIG. 4. Referring to FIGS. 8 and 9, the preferred embodiment of the lock structure 225 is shown as including a lock housing 226 having a bore 228. A detent is received within the bore 228 and includes a pin 232 having a rounded first end 234 and a second end 236 engaging a spring 238. As illustrated in FIGS. 5 to 7, the lock housing 226 is received within the bottom inner horizontal rail member 220 wherein the first end 234 of the pin 232 extends through an aperture 240 (FIG. 8) in the rail member 220. As the inner horizontal rail members 216, 218, 220 are in sliding engagement with the outer horizontal rail members 206, 208, 210, the pin 232 is adapted to engage one of a plurality of apertures 242, 244 formed in the bottom outer horizontal rail 210 (FIG. 6). As seen in FIG. 8, a shoulder 246 adjacent the second end 236 of the pin 232 has a diameter greater than the diameter of the aperture 240 wherein the detent 228 is retained within the lock assembly 225.

In operation, as the side rail is extended from the fully retracted position "A", the spring biased pin 232 will engage a first aperture 242 thereby locking the second portion 204 of the side rail 200 in the intermediate position "B". By depressing the pin 232, the second portion 204 is released for movement and may be either retracted or extended. If extended, the pin 232 will engage a second aperture 244 wherein the second portion 204 is locked in a fully extended position "C" relative to the first portion 202. It is readily apparent that additional apertures could be provided for defining additional intermediate locking or positive stop positions.

Figure 11:
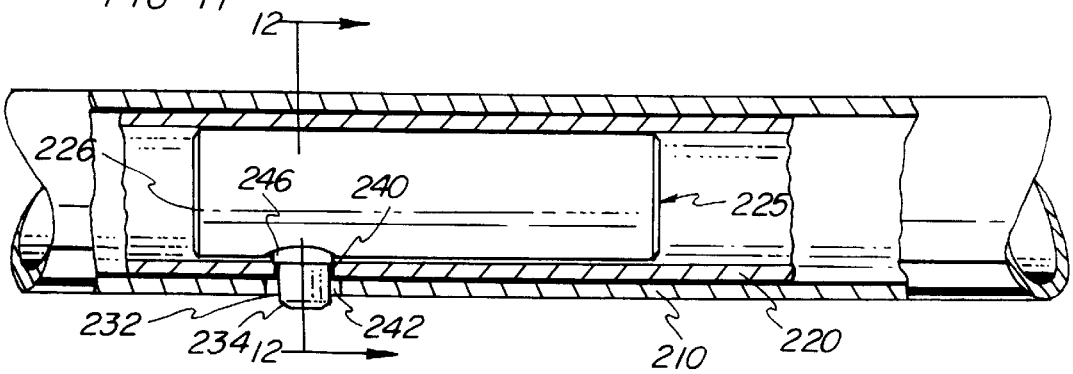
FIG. 11 is a partial side view of the bottom inner horizontal rail member with a partial cut-away showing the lock structure of the invention.
Figure 12:
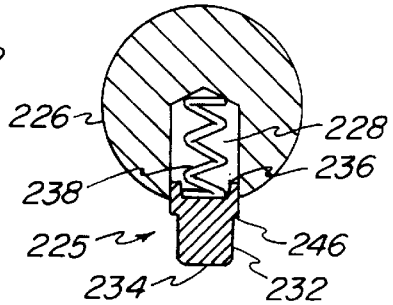
FIG. 12 is a cross sectional view of the lock structure taken along line 12—12 in FIG. 11.
Figure 16:
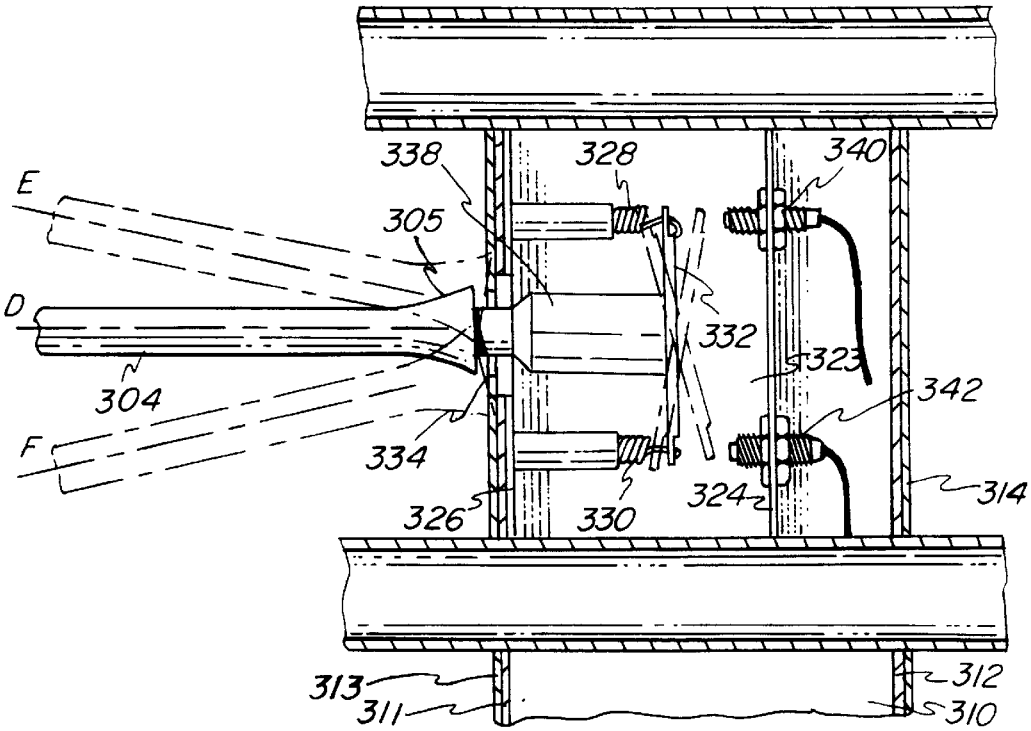
FIG. 16 is a cross sectional side view of the controller of the invention taken along line 16—16 in FIG. 14.
Figure 13:
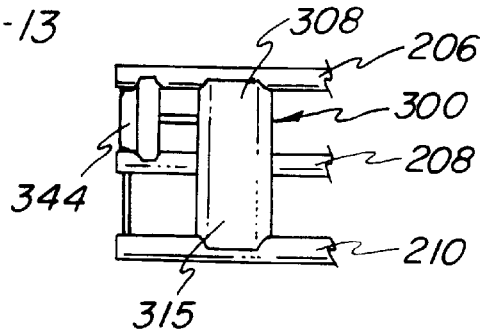
FIG. 13 is a back view of the controller of the invention shown mounted to the side rail.
Figure 14:
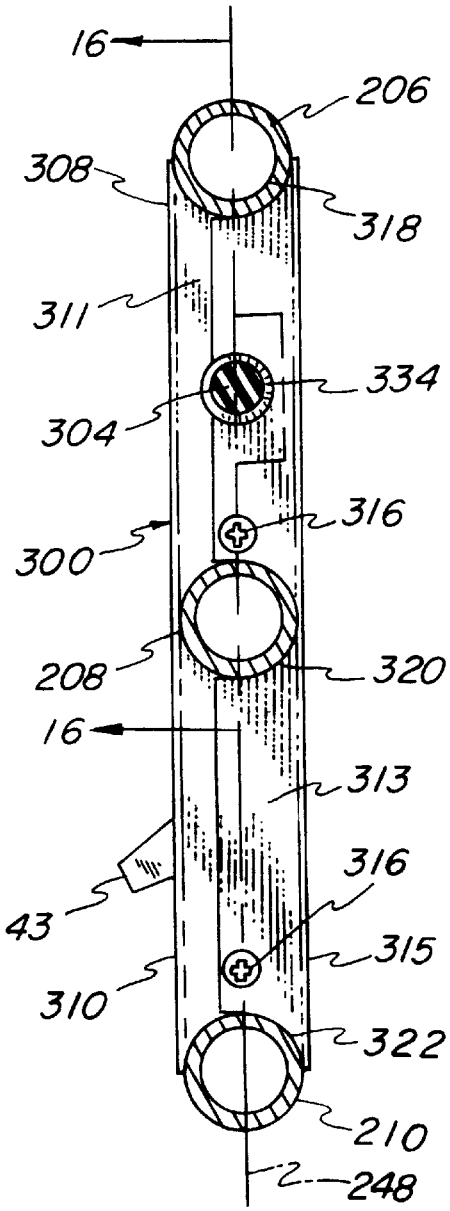
FIG. 14 is a right side view of the controller of FIG. 13.
Figure 15:
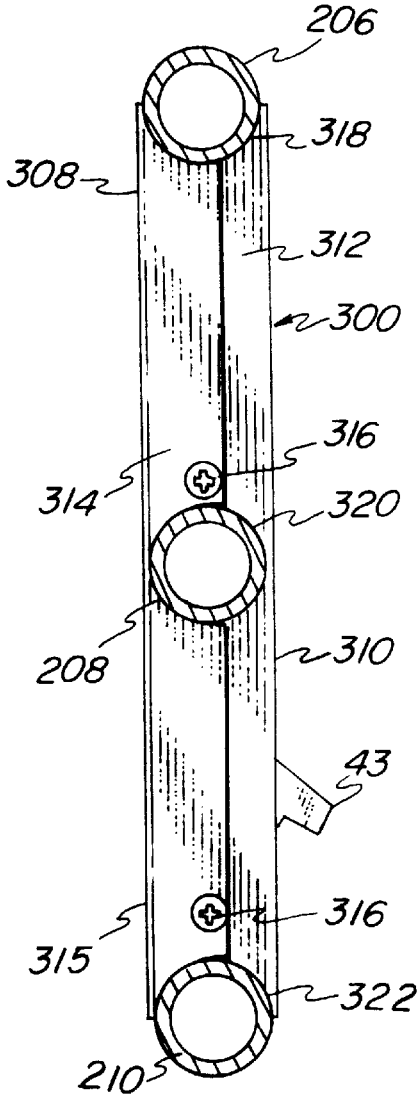
FIG. 15 is a left side view of the controller of FIG. 13.

Referring to FIGS. 5, 11 and 14, the outer horizontal rail members 206, 208, 210 and vertical rail members 212, 214 define a side rail plane 248 in which a controller 300 is located. The controller 300 preferably comprises a control stick movably mounted between the vertical rail members 212, 214 (FIGS. 5 and 14). The control stick includes an elongated rod 304 having a proximal end pivotally mounted within a control box 308 (FIG. 13) and a distal end 306 located adjacent to the vertical rail member 214 (FIG. 14). Turning to FIGS. 5 and 10–14, the control box 308 includes a front cover 310 having side walls 311, 312 which are secured to side walls 313, 314 of a rear cover 315 by a plurality of screws 316. The front cover side walls 311, 312 and rear cover side walls 313, 314 together form mounting portions 318, 320, 322 for receiving the outer horizontal rail members 206, 208, 210, respectively, such that the control box 308 is restrained from movement.

Referring to FIG. 13, a mounting bracket 323 is secured to an inside surface of the front cover 310 and includes inner and outer wall members 324 and 326. Springs 328 and 330 connect the outer wall member 326 to a pivot plate 332. The elongated rod 304 passes through aperture 334 formed in the front cover side wall 311, rear cover side wall 313 and outer wall member 326 of the mounting bracket 323. The aperture 334 has a diameter greater than that of the elongated rod 304 thereby permitting relative movement therebetween. An extension rod 338 connects the elongated rod 304 to the pivot plate 332 such that the elongated rod 304 is pivotally mounted. The springs 328, 330 act to bias the extension rod 338 and elongated rod 304 towards a neutral horizontal position represented by reference letter "D" in FIG. 13. A pair of switches 340, 342 are mounted within inner wall member 324 of the mounting bracket 323 wherein the switch 340 is triggered when the rod 304 is in an upward position, as represented by reference letter "E", and switch 342 is triggered when the rod is in a downward position, as represented by reference letter "F". The switches 340, 342 are preferably in the form of optical sensors for sensing the pivot plate 332.

Turning again to FIGS. 5, 10 and 14, a guide member 344 prevents excessive travel and subsequent breakage of the elongated rod 304. The guide member 344 includes a slot 346 adjacent the distal end 306 of the elongated rod 304 and a mounting portion 350 for clamping about the vertical rail member 214. To securely fix the guide member 344 to the side rail 200, the guide member 344 is welded to the top and middle outer horizontal rail members 206, 208. While in the preferred embodiment the elongated rod 304 of the control stick is mounted horizontally between the top and middle outer horizontal rail members 206, 208 adjacent to vertical rail member 214, it is to be understood that this in no way limits the invention and that the elongated rod 304 could be mounted in a number of different locations and orientations within the side rail plane 248.

With reference to FIG. 13, as the elongated rod 304 is moved in a first or upward direction "E", the switch 340 is triggered thereby actuating the motor 156 for driving the upper body section 62 upwardly in a manner as described above. When the control stick 302 is released, the springs 328, 330 return the elongated rod 304 to a neutral horizontal position "D" wherein the motor 156 is inactive. As the elongated rod 304 is moved in a second or downward direction "F", the switch 342 is triggered whereby the motor 156 is actuated for driving the upper body section 62 downwardly. As detailed above, when the upper body section 62 is moved, the seat section 64 and lower leg section 66 articulate in response.

From the above description, it should be apparent that the present invention provides an articulated medical bed having an articulated support frame of an adjustable length which is adjustable by a single actuator wherein the user's feet are always maintained at a higher elevation than his hips. Furthermore, the present invention provides a horizontally adjustable side rail having locking stop positions intermediate fully retracted and fully extended positions wherein a control stick for actuating the actuator is positioned within a plane as defined by the side rail.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. An articulated bed comprising:

a main frame defining a base;

an articulated support frame mounted to said base for supporting a person in articulated movement;

said support frame including an upper body section, a seat section, and a lower leg section;

a pivot connection connecting said upper body section to said base for pivotal movement of said upper body section relative to said base, said pivot connection positioned at a longitudinal location between first and second ends of said upper body section;

said seat section including a first end pivotally connected to said second end of said upper body section at an upper articulable connection and a second end pivotally connected to a first end of said lower leg section at a lower articulable connection;

said upper and lower articulable connections supported for vertical movement;

an elongated link member having a first end pivotally connected to said base and a second end pivotally connected to a second end of said lower leg section; and a glide member mounted on said seat section and supported on said base for linear movement along said base whereby said seat section is supported for rocking movement about said glide member in response to pivotal movement of said upper body section about said pivot connection.

2. The bed of claim 1, wherein said main frame defines an upwardly facing elongated support portion and said glide member moves along said support portion.

3. The bed of claim 1 wherein said glide member comprises a roller mounted to an axle and said axle is mounted to said seat section at a predetermined distance below said seat section and at a longitudinal location between said first and second ends of said seat section.

4. The bed of claim 1 wherein said first end of said link member is connected to said base at a longitudinal location between said first and second ends of said lower leg section.

5. The bed of claim 1 including a linear actuator connected to said upper body section for actuating said upper body section in pivotal movement whereby said seat section and said lower leg section are simultaneously actuated for articulated movement.

6. The bed of claim 5 including a side rail mounted to said main frame and a controller mounted to said side rail and connected to said linear actuator for controlling operation of said linear actuator.

7. The bed of claim 5 wherein said linear actuator includes a first end mounted to said main frame and a second end attached to said upper body section between said pivot connection and said first end of said upper body section.

8. The bed of claim 1 wherein said lower leg section is detachably mounted to said seat section and to said link member whereby said lower leg section is replaceable with a further lower leg section having a different length.

9. The bed of claim 1 wherein said support frame further comprises a pocket section supported between said upper body section and said seat section above said upper articulable connection.

10. The bed of claim 9 wherein:

said upper body section and said seat section each include a mattress supporting structure including a plurality of laterally extending mattress supports; and said pocket section includes a plurality of pocket supports extending longitudinally between one of said plurality of mattress supports of said upper body section and one of said plurality of mattress supports of said seat section.

11. The bed of claim 10 wherein each of said plurality of pocket supports includes:

a first end pivotally connected to one of said plurality of mattress supports of one of said upper body section and said seat section; and a second end slidably supported by one of said plurality of mattress supports of the other of said upper body section and said seat section.

12. A support frame for an articulated bed, said support frame comprising:

an upper body section including opposing first and second ends;

a seat section including opposing first and second ends said first end of said seat section pivotally connected to said second end of said upper body section at an upper articulable connection said upper body section and said seat section selectively movable to define a V-shaped pocket between said upper body section and said seat section;

a lower leg section including opposing first and second ends said first end of said lower leg section pivotally connected to said second end of said seat section at a lower articulable connection; and a pocket section connected to said upper body section and said seat section above said upper articulable connection and positioned within said V-shaped pocket, said pocket section including at least one longitudinally extending pocket support having opposing first and second ends said second end of said at least one pocket support supported for sliding movement relative to at least one of said upper body section and said seat section.

13. The support frame of claim 12 wherein:

said upper body section and said seat section each include a mattress supporting structure including a plurality of laterally extending mattress supports; and said pocket section includes a plurality of pocket supports extending longitudinally between one of said plurality of mattress supports of said upper body section and one of said plurality of mattress supports of said seat section.

14. The bed of claim 13 wherein each of said plurality of pocket supports includes:

a first end pivotally connected to one of said plurality of mattress supports of one of said upper body section and said seat section; and a second end slidably supported by one of said plurality of mattress supports of the other of said upper body section and said seat section.

* * * * *